US005795273A

United States Patent [19]

Lochbaum

[11] Patent Number: 5,795,273

[45] Date of Patent: Aug. 18, 1998

[54] ADJUSTABLE RESISTANCE AQUATIC EXERCISE DEVICE

[76] Inventor: Kenneth Lochbaum, 3002 E. 38th St., Erie, Pa. 16510

[21] Appl. No.: 772,419

[22] Filed: Dec. 23, 1996

Related U.S. Application Data

[60] Division of Ser. No. 451,674, May 26, 1995, Pat. No. 5,611,763, which is a continuation-in-part of Ser. No. 365,498, Dec. 28, 1994, Pat. No. 5,533,950.

[51] Int. Cl.[6] ..... A63B 21/008

[52] U.S. Cl. ..... 482/111

[58] Field of Search ..... 482/111, 54

[56] References Cited

U.S. PATENT DOCUMENTS 2,875,528 3/1959 Garate .
3,415,475 12/1968 Goddman .
3,861,675 1/1975 Hopper .
4,145,044 3/1979 Wilson et al. .
4,170,799 10/1979 Ratelband .
4,247,096 1/1981 Schmitt .
4,759,544 7/1988 Diaz .
4,784,385 11/1988 D'Angelo .
5,219,317 6/1993 Beasley .
5,242,352 9/1993 Elliott .
5,372,564 12/1994 Spirito .

*Primary Examiner*—Lynne A. Reichard
*Attorney, Agent, or Firm*—Lovecheck and Lovecheck

[57] ABSTRACT

The aquatic exercise device may be used in a container of water. The exercise device has an opening covered by a slidable panel which may be moved from an open to a closed position to change the resistance of the device to movement in water. The device may be made of plastic plumbing fittings and plastic plumbing pipe.

12 Claims, 2 Drawing Sheets

ADJUSTABLE RESISTANCE AQUATIC EXERCISE DEVICE

BACKGROUND OF THE INVENTION

This application is a Division of Ser. No. 08/451,674, filed May 26, 1995, now U.S. Pat. No. 5,611,763 which is a continuation-in-part application of Ser. No. 08/365,498 filed Dec. 28, 1994 now U.S. Pat. No. 5,533,900.

Aquatic exercise devices must be movable under water and should be adjustable to provide water resistance for different conditions and for different people. Applicant has provided an exercise device which may be shaped like a window frame hinged at its bottom. The window frame may have slidable panels that can be received in slots in the edge of the window frame. An improved support means is provided to support the panels from open to closed position thereby varying the size of the openings and consequently changing the amount of required force to overcome the resistance to water required to move the frame through the water.

Applicant is aware of the following U.S. Pat. Nos.: 2,875,528 to Garate; 3,415,475 to Goodman; 3,861,675 to Hopper; 4,145,044 to Wilson; 4,170,799 to Ratelband; 4,247,096 to Schmitt; 4,759,544 to Diaz; 4,784,385 to D'Angelo; 5,219,317 to Beasley; 5,242,352 to Elliott; and, 5,372,564 to Spirito.

SUMMARY OF THE INVENTION

It is an object of the present invention to provide an aquatic exercise device that is simple in construction, economical to manufacture and simple and efficient to use.

It is another object of the present invention to provide an aquatic exercise device in which the resistance to movement of the device in water can be adjusted and that can be used in any depth of water or while the person exercising is fully immersed in the water.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
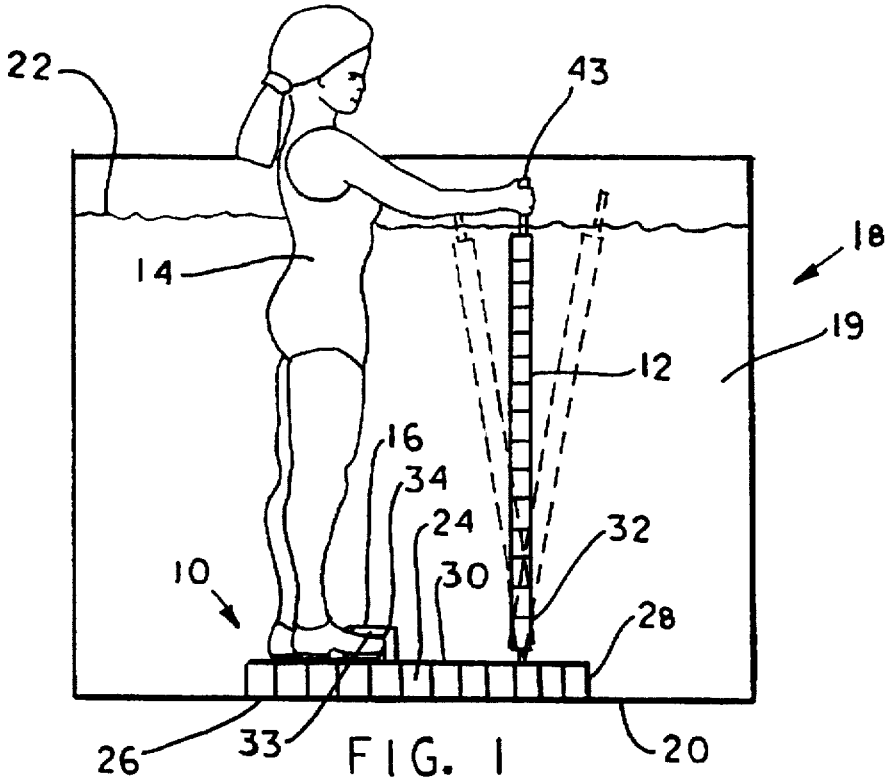
FIG. 1 is a side view of a container of water with one side wall of the container removed showing an exercising device supported on a base and a foot stabilizer according to the invention.

Now with more particular reference to the drawings, FIG. 1 shows base member 10 supporting exercise device 12.

Person 14 is supported in an exercise position on base member 10 by aquatic foot stabilizer device 16. In the example shown in FIG. 1, exercise device 12 may be made of plastic pipe and fittings of a type familiar to those skilled in the art.

Without foot stabilizer device 16, person 14 would not be able to maintain a stationary exercising position due to the buoyancy of water 19. Container 18 of water 19 could be a pool, exercise tank, pond, lake or river for example. Water 19 has top surface 22 and a depth between bottom 20 and top surface 22 sufficient to provide an aquatic exercise environment.

Base member 10 may cover the entire bottom 20 or a part thereof. Base member 10 may be permanently attached or removably attached to bottom 20. Base member 10 may be made of pieces of plastic pipe 24 set on end and attached together by suitable adhesive to form a flat top surface with continuous equally spaced openings 30 disposed in rows and columns to receive posts 32 for stabilizing on exercise device 12. Openings 30 in top ends of pipe 24 also provide a wide range of positions for exercise device 12 and for foot stabilizer device 16.

Posts 32 may be the same shape as openings 30, or may be non-circular in cross section, that is, square, hexagonal, octagonal, or oval to provide a better holding force with the side walls of openings 30.

Figure 2:
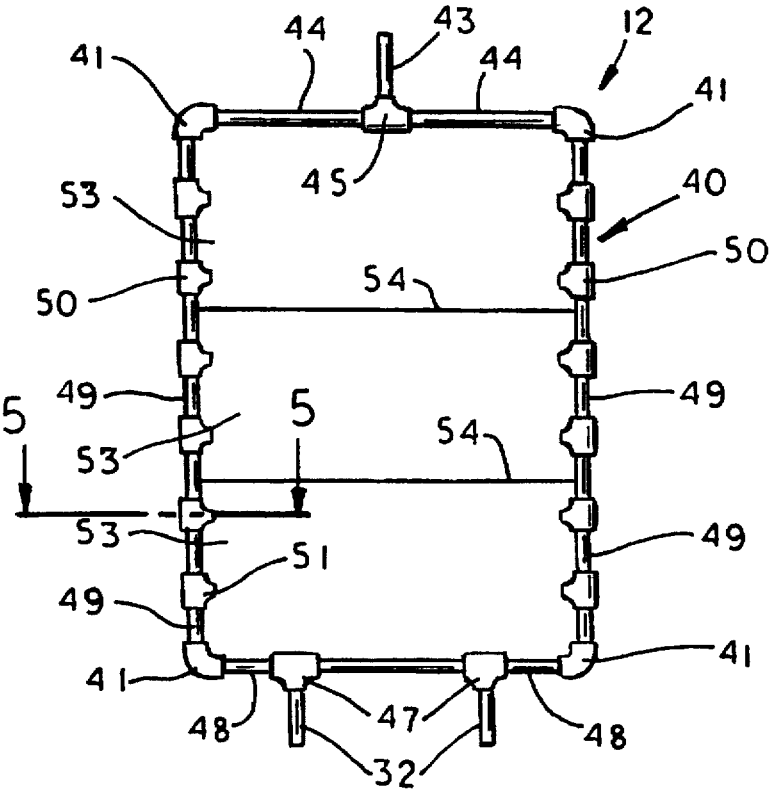
FIG. 2 is a front view of the exercising device shown in FIG. 1.
Figure 5:
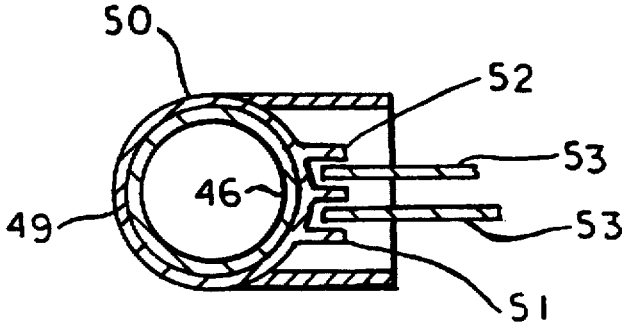
FIG. 5 is a cross sectional view taken on line 5—5 of FIG. 2.

Aquatic exercise device 12 shown in FIGS. 1, 2 and 5 has rectangular frame 40 with corners made of elbows 41 connected to plastic pipe 44,49. Handle 43 is held in place by T-fitting 45 that is connected to pipes 44. T-fitting 50 has a lateral branch with outwardly extending flanges 51 which have slots 52 therein. Slots 52 receive edges 46 of panels or panes 53,55 Panels 53 overlap at 54 so that they can be slid into and out of overlying positions thereby increasing or decreasing the resistance of water 19 in exercising device 12 as it is swung in water 19 by person 14. Posts 32 are received in T-fittings 47 and in openings 30 in base 10. T-fittings 47 are connected together by pipe 42. Pipes 48 are rotatably received in T-fittings 47 so that posts 32, T-fittings 47 and pipe 42 can rotate relative to pipe 48.

Aquatic foot stabilizer device 16, shown in FIG. 1 has a support bar attached to post 34. Post 34 is received in one of openings 30 in base member 10. Person 14 can insert the front part of her foot into open end 33 of stabilizer device 16 to hold her foot and her body in position.

Figure 3:
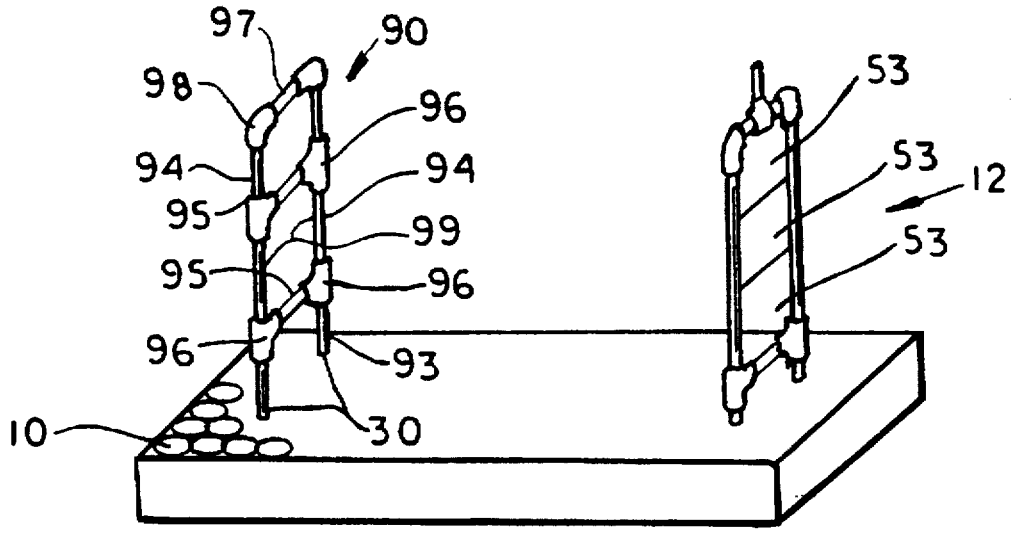
FIG. 3 is an isometric view of an upright stabilizer with a belt stabilizer for engaging the body of a person and an exercise device supported on the base.

FIG. 3 shows stabilizer 90 and exercising device 12. Stabilizer 90 has upright members 94 having lower ends 93 received in holes 30 in base member 10. Flexible belt 99 is attached to upright members 94. Upright members 94 and transverse member 95 are held together by plastic T-fittings 96. Transverse member 97 is attached to elbows 98.

Figure 4:
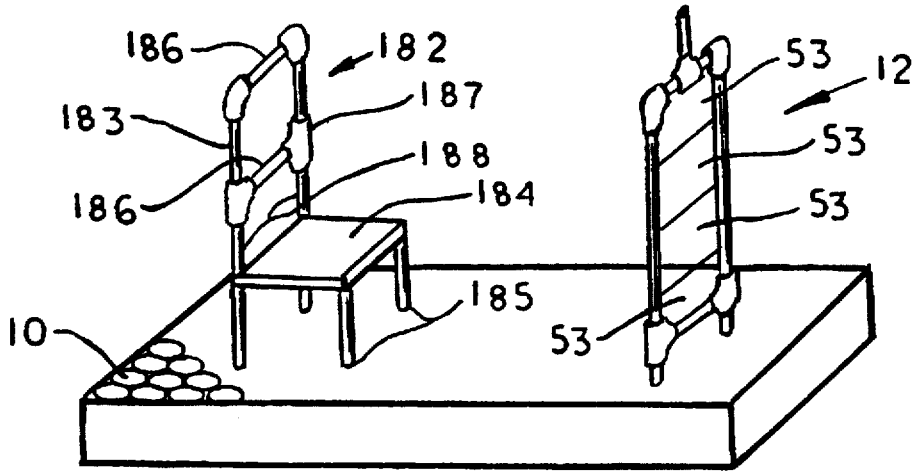
FIG. 4 is an isometric view of a base having a chair stabilizer and an exercise device.

FIG. 4 shows exercise device 12 like shown in FIG. 3 and chair 182. Chair 182 has upright members 183, seat 184 and legs 185. Legs 185 are attached to the corners of seat 184. Upright members 183 are rigidly supported generally parallel to each other by cross members 186 and T-fittings 187. Lower ends of upright members 183 and legs 185 are received in openings 30 in base 10. One or more belts 188 may be provided to secure person 14 in a desired exercise position on chair 182.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. An aquatic exercise device comprising a frame in the form of a window sash having an opening;

said frame having a top, a bottom and sides;

a slot in said sides said top having hand engaging means;

whereby said frame can be swung relative to said water; and, relatively flat window pane having an edge received in said slot whereby said window pane can be slid from an open to a closed position to change the size of said opening and thereby change the force of water on said device during exercise;

said frame comprises a hinge means for supporting said frame on one end thereof whereby said frame can be swung relative to water in which it is immersed.

2. The device recited in claim 1 wherein two said plate-like window panes are provided;

one of said panes being adapted to slide in said slot to overlie the other said pane.

3. The device recited in claim 1 wherein at least two said pane is supported in said frame.

4. The device recited in claim 1 wherein said sides and said ends are connected together by plastic plumbing Tees and elbows.

5. The device recited in claim 4 wherein said frame includes plastic pipe inserted in said elbows and in said plastic plumbing Tees and Tees forming said frame.

6. The device recited in claim 5 wherein said Tees have a lateral branch; and, said slot is formed in said lateral branch to receive edges of said panes.

7. An aquatic exercise device comprising a rectangular frame;

said frame having an opening;

a handle means attached to said frame;

at least one relatively flat member slidably supported on said frame whereby said relatively flat member can be positioned to close said opening in said frame or to open said opening to change the resistance to movement of said frame in water;

hinge means on said frame for supporting said frame in said body of water.

8. A device for aquatic exercise comprising a frame with an opening;

a window pane supported on said frame and movable to a position closing said opening to a position spaced from said opening whereby the resistance to movement of said device in water is changed;

hinge means on said frame for supporting said frame in said body of water.

9. An aquatic exercise device comprising a generally rectangular frame having an opening;

said frame having a top, a bottom and sides;

said top having hand engaging means;

said bottom being swingably attached to a base;

said sides having panel engaging means on their inwardly facing surfaces;

said panel engaging means being adapted to adjustably support two or more panels in said opening in said frame to adjust the resistance to movement of said frame in water.

10. The aquatic exercise device recited in claim 9 wherein said panel engaging means comprises a slot at each side to adjustably support each panel.

11. The aquatic exercise device recited in claim 9 wherein said panel engaging means comprises slots extending substantially the length of the inward facing surface of the frame sides;

whereby said panels may each be positioned at any point to increase or decrease the resistance to movement of said frame as desired.

12. The aquatic exercise device recited in claim 9 wherein said frame is rotatably attached to the base by a hinge whereby said frame can be swung relative to the water in which it is immersed.

* * * * *